United States Patent [19]

Barlow

[11] Patent Number: 4,746,125

[45] Date of Patent: May 24, 1988

[54] MANIPULATIVE GAME

[75] Inventor: Gordon A. Barlow, Glenview, Ill.

[73] Assignee: Gordon Barlow Design, Skokie, Ill.

[21] Appl. No.: 58,407

[22] Filed: Jun. 5, 1987

[51] Int. Cl.[4] ..... A63F 9/00

[52] U.S. Cl. ..... 273/1 GC; 273/1 GD; 273/1 GG

[58] Field of Search ..... 273/1 GC, 1 GD, 1 GG, 273/1 GB, 1 GA

[56] References Cited

U.S. PATENT DOCUMENTS

| | | | |
|---|---|---|---|
| 577,730 | 2/1897 | Eberhardt | 273/1 GG X |
| 2,460,146 | 1/1949 | Prentice | 273/1 GC |
| 3,232,610 | 2/1966 | Campbell | 273/1 GC X |
| 3,249,357 | 5/1966 | Lochsinger | 273/1 GD |
| 3,333,846 | 8/1967 | Glass et al. | 273/1 GC |
| 3,547,436 | 12/1970 | Breslow | 273/1 GC |
| 3,602,503 | 8/1971 | Schwartz et al. | 273/1 GC |
| 3,836,142 | 9/1974 | Baker | 273/1 GD |
| 4,039,184 | 8/1977 | Breslow et al. | 273/1 GC |
| 4,177,987 | 12/1979 | Zimmerman | 273/1 GG |
| 4,272,075 | 6/1981 | Rogers, Jr. | 273/1 GC |
| 4,300,762 | 11/1981 | Goldfarb et al. | 273/1 GC |
| 4,673,181 | 6/1987 | Baran | 273/1 GG X |

*Primary Examiner*—Paul E. Shapiro

*Attorney, Agent, or Firm*—Kinzer, Plyer, Dorn, McEachran & Jambor

[57] ABSTRACT

A game including a hollow housing in the shape of a chicken or hen having an outlet opening for a marble which represents an egg. An inclined ramp leads from the marble outlet opening. A detent is located in the inclined ramp to restrain movement of a marble past the detent on the ramp. A shield extends over the detent to restrict access to a marble retained by the detent. An opening extends through the shield to permit generally vertical access to a marble held by the detent. An electrically conductive ring encircles the opening. A circular magnet is mounted on the underside of the electrically conductive ring generally coaxial therewith. A metal probe having an insulated handle is provided with an insulated electric wire connecting the metal probe to a battery power supply. A direct current miniature motor and the electrically conductive ring are provided in an electrical circuit with the battery power supply and probe so that the engagement of the metal probe with the electrically conductive ring completes the circuit and actuates the direct current electric motor. A shuttle driven by the electric motor through a gearing arrangement actuates wings pivotally attached to the hollow housing on opposite sides thereof to create noises and a visual effect indicating that the player failed to remove an egg without disturbing the chicken.

3 Claims, 2 Drawing Sheets

MANIPULATIVE GAME

BACKGROUND AND SUMMARY OF THE INVENTION

This invention is directed to a battery-operated game which challenges both the skill and dexterity of the players in comparing their ability to remove marbles representing eggs from an inclined ramp extending from the front of a replica of a chicken using a metal probe to dislodge a marble, representing an egg, one at a time from a detent in the inclined ramp without "disturbing the chicken."

"Disturbing the chicken" means to cause the chicken to rapidly flap its wings which provides both a visual and an audible signal to the other players that the player has failed in his attempt to skillfully remove an egg. The marble, representing an egg, which is sought to be plucked from the chicken's care, is detained on an inclined ramp projecting from the front of the chicken. To make the removal of the egg more difficult, a shield, also projecting from the front of the chicken, is positioned over the restrained egg allowing access to the marble by the probe only through an opening formed in the shield. To remove an egg from the detent on the inclined ramp, the probe must be extended through the opening and the end of the probe used to pry the egg over the detent on the ramp. A metal ring is positioned surrounding the opening. The metal ring is part of an electrical circuit, which includes batteries and an electrical motor located in the hen and the metal probe which is connected to the circuit by a wire. If during the attempt to dislodge the egg using the probe a player contacts the metal ring, the electrical circuit is closed and the electrical motor is actuated. Actuation of the motor causes the wings of the chicken to flap, thereby creating the visual and audible signals indicating that the player has been unsuccessful in removing an egg without disturbing the chicken. The difficulty of removing an egg from its detained position under the shield is enhanced by the use of a circular magnet positioned coaxially under the metal ring and around the opening. The magnet draws the metal probe toward the metal ring to complete the circuit. If the player moves his probe too close to the magnet during his manipulation, it will be pulled to the metal ring and the chicken will be disturbed. If the "chicken is disturbed" at any time during the player's attempt to remove an egg or to remove the probe after removing one or more eggs, the player loses that turn and the egg is returned to the chicken.

The chicken is designed to hold a minimum of six eggs and each player is given a plastic tray with six depressions formed therein so that the first player to successfully recover six eggs wins the game. Any number of eggs are poured into the chicken through an opening and rolled down the inclined ramp to where they are stopped by the retaining wall which locates at least one of the eggs under the opening in the shield.

Other objects and purposes of the invention will be found in the following specification, drawings and claims.

BRIEF DESCRIPTION OF THE DRAWINGS

The invention is illustrated more or less diagrammatically in the following drawings wherein.

DESCRIPTION OF THE PREFERRED EMBODIMENT

Figure 1:
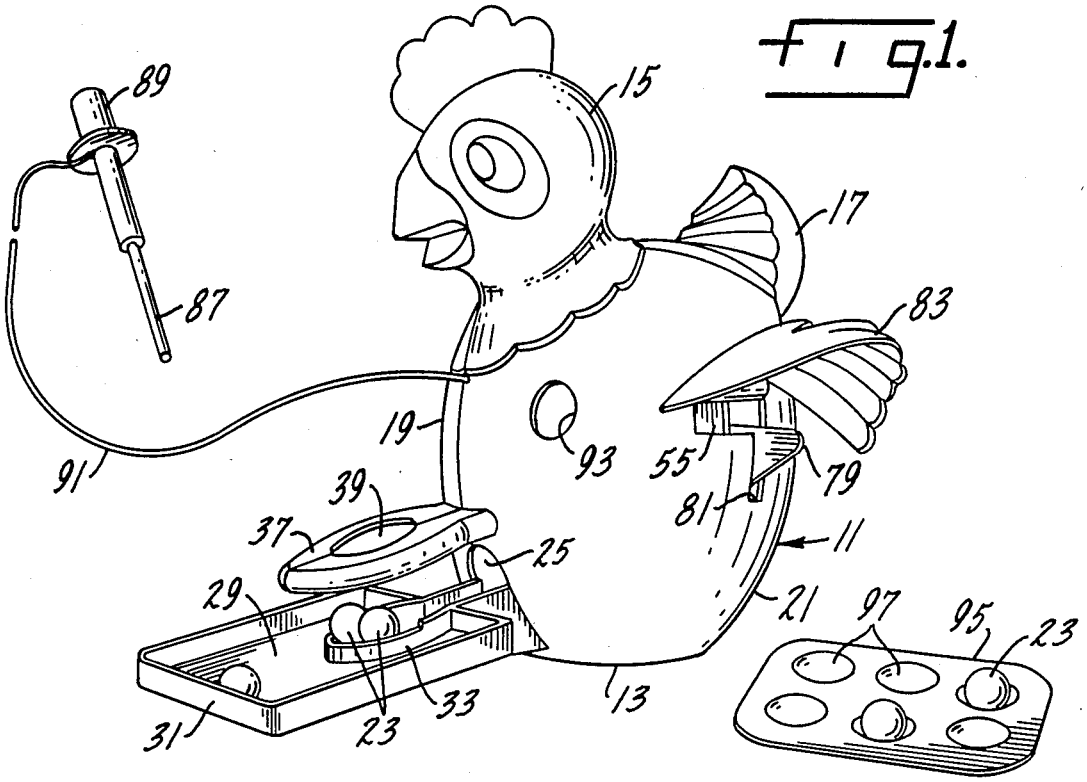
FIG. 1 is a perspective view of the game of this invention.
Figure 2:
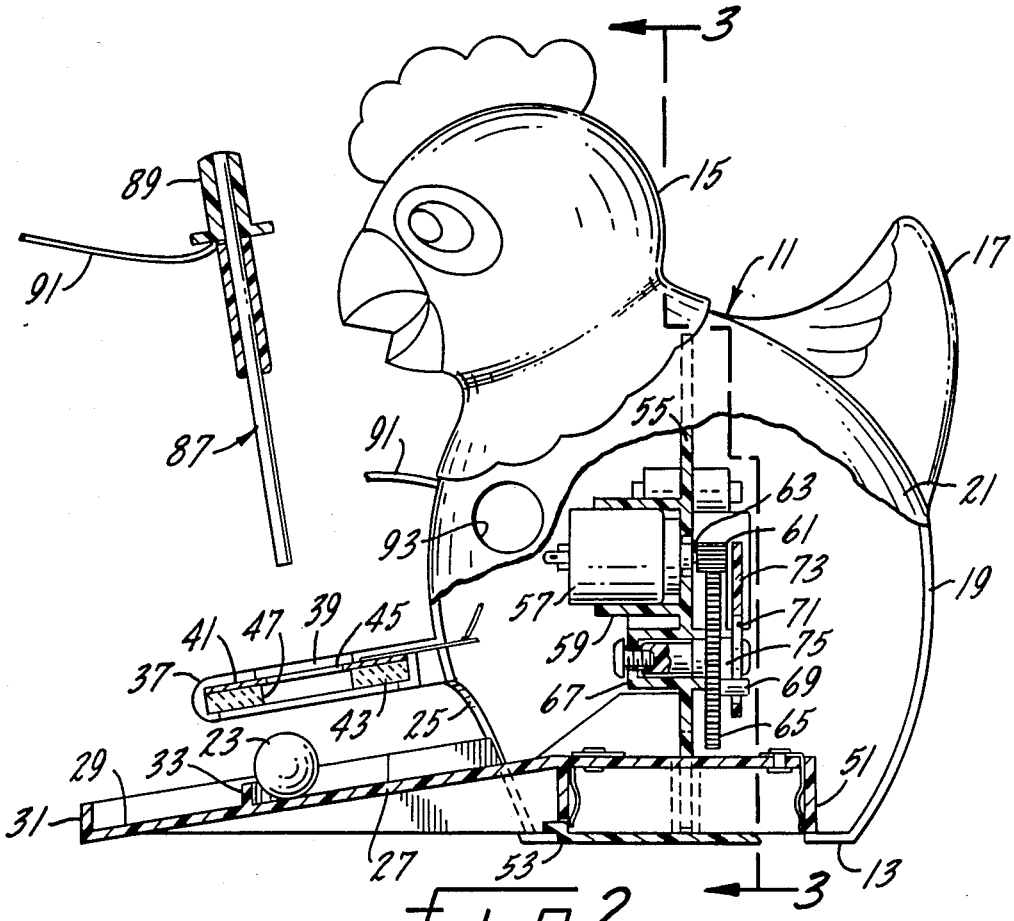
FIG. 2 is an enlarged, partial side elevational view of the game of FIG. 1 with some parts broken away and others shown in cross-section for clarity of illustration.
Figure 3:
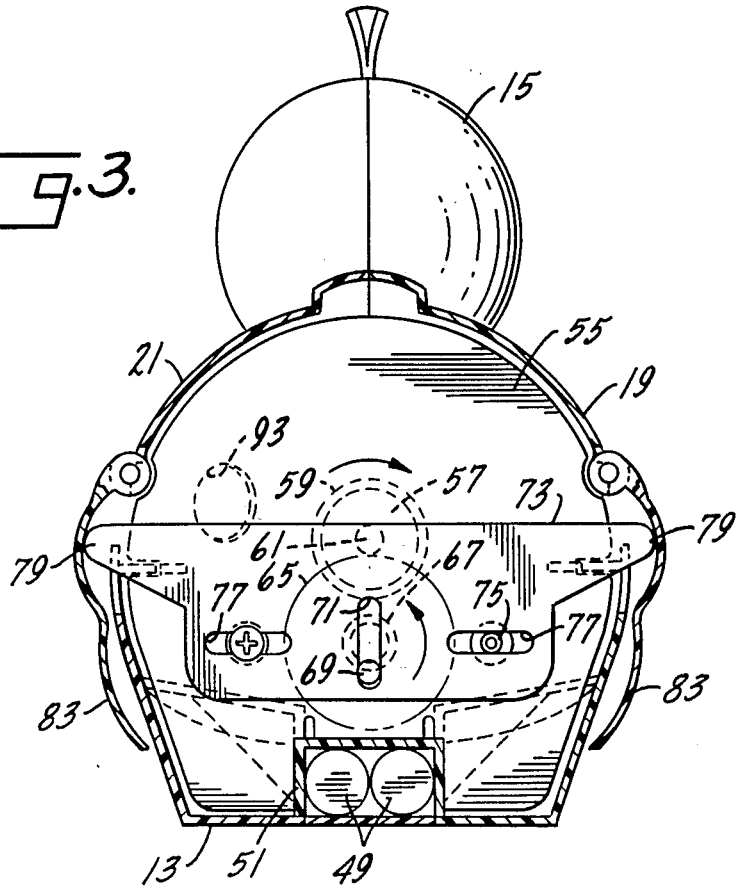
FIG. 3 is a cross-sectional view taken along line 3—3 of FIG. 2.

FIG. 1 of the drawings shows a hollow housing 11 formed in the replica of a chicken or hen. The housing has a flat bottom 13 on which it rests. A projection 15 resembling the head of a chicken and a rear projection 17 form to resemble a tail. For convenience of manufacture, the hollow housing is made into two half shells 19 and 21 split vertically down the middle of the housing. The two shell halves are joined together in any conventional manner to form the hollow housing 11. Marbles 23 are used to represent eggs stored in the chicken.

A marble 23 outlet opening 25 is formed in the two shell halves 19 and 21 at the front of the housing and an inclined ramp 27 extends out of this opening. The outer end of the inclined ramp is widened into a tray 29 which is capable of holding at least several marbles 23. The tray has an outer peripheral wall 31 to retain the marbles on the tray. An inner semi-circular wall extends around the marble outlet opening 25 of the chicken to restrain the marbles at a position about half way down the inclined ramp. A shield 37 formed integrally with the sections of the hollow housing 11 extends over the inclined ramp 27 and is located above the inclined ramp sufficiently high so as not to interfere with the movement of the marbles on the inclined ramp. The shield is actually made in two sections; one extending from each of the shell halves 19 and 21. An opening 39 is formed vertically through the shield and aligns generally with the inner semi-circular peripheral wall 33 on the tray 29. Supported on the shield and located coaxially to each other and the opening 39 are an upper steel ring 41 and a lower circular magnet 43. The ring has an inner opening 45 of smaller diameter than the inner opening 47 of the magnet.

A battery box 51 sized to hold two AA batteries 49 is located in the flat bottom 13 of the hollow housing with a snap-in door opening 53 provided in the flat bottom 13 of the housing for access to the battery box. Mounted on top of the battery box inside the hollow housing is a vertically extending partition 55 extending between the shell halves 19 and 21 of the hollow housing. The miniature electric motor 57 is mounted in a socket 59 formed integrally in the partition. A pinion gear 61 connected to the output shaft 63 of the electric motor meshes with a gear 65 which has its shaft journaled in a socket 67, also formed integrally with the vertical partition 55. A post 69 eccentrically mounted on the face of the gear 65 fits in a vertical slot 71 in a shuttle 73 mounted on the vertical partition 55 by means of a pair of posts 75 which fit into longitudinally extending slots 77 formed in the shuttle. The shuttle has tips 79 at its opposite ends which extend through openings 81 in the shell halves 19 and 21 to engage wings 83 which are pivotally mounted on the shell halves 19 and 21.

An electrical circuit is provided to connect the batteries 49, electrical motor 57 and steel ring 41 to a metal probe 87. The metal probe has a plastic handle 89, and an insulated conductive wire 91 connects the probe to the electrical circuit. When the probe rod 87 contacts the steel ring 41, the electric circuit is closed and the electric motor 57 is actuated to reciprocate the shuttle 73, thereby flapping the wings 83. Operation of the motor, shuttle and wings creates not only a visual notification that the circuit is closed but also an audible one. The circular magnet 43 not only makes it more difficult for the player to insert the probe through the opening 39 in the shield by attracting the probe to the steel ring 41, but also holds the probe in contact with the steel ring for a longer period of time once contact is made so that the electric motor will be actuated a long enough period of time to indicate to the players that a contact has been made. Once the probe comes in contact with the magnet, it takes an additional amount of work for the player to remove it and interrupt the electrical circuit.

The marbles 23 are loaded into the hollow housing 11 through a marble opening 93 located in a side wall of one of the shell halves 19 or 21. The marbles roll down the inclined ramp 27 through the marble outlet opening 25 to the inner semi-circular wall 33 where they are retained under the opening 39 in the shield.

Each player is provided with a plastic tray 95 having six depressions 97 formed therein. Eggs 23 which are safely removed from the chicken by the player are stored in the tray 95 during the course of a game.

I claim:

1. A game including:

a hollow housing having an outlet opening for a marble, an inclined ramp leading from the marble outlet opening, a detent in the inclined ramp sufficient to restrain movement of a marble past the detent on the ramp, a shield extending over the detent to restrict access to a marble retained by the detent, an opening extending through the shield permitting generally vertical access to a marble held by the detent, an electrically conductive ring encircling the opening, a circular magnet mounted on the electrically conductive ring generally coaxial therewith, a metal probe having an insulated handle, an insulated electric wire connecting the metal probe to a battery power supply, a direct current miniature motor and the electrically conductive ring so that engagement of the metal probe with the electrically conductive ring completes a circuit and actuates the direct current electric motor, and means connected to the electric motor to indicate that the circuit has been completed.

2. The toy of claim 1 in which the means connected to the electric motor to indicate that the circuit has been completed includes a shuttle driven by the electric motor through a gearing arrangement and wings pivotally attached to the housing on opposite sides thereof and engaged by the shuttle when it is moved by operation of the electric motor.

3. The toy of claim 1 in which an additional opening is provided in the hollow housing to place marbles in the housing where they are fed to the inclined ramp.

* * * * *